United States Patent [19]

Gonczy

[11] Patent Number: 4,472,351

[45] Date of Patent: Sep. 18, 1984

[54] DENSIFICATION OF METAL-CERAMIC COMPOSITES

[75] Inventor: Stephen T. Gonczy, Mount Prospect, Ill.

[73] Assignee: UOP Inc., Des Plaines, Ill.

[21] Appl. No.: 491,836

[22] Filed: May 5, 1983

[51] Int. Cl.[3] ..... B22F 1/00

[52] U.S. Cl. ..... 419/46; 419/14; 419/15; 419/47; 501/93

[58] Field of Search ..... 264/65; 419/14, 15, 419/46, 47; 501/93

[56] References Cited

U.S. PATENT DOCUMENTS 4,040,823 8/1977 Yamaguchi ..... 419/15

4,097,275 6/1978 Horvath ..... 419/47

4,320,204 3/1982 Weaver ..... 419/15

*Primary Examiner*—Leland A. Sebastian

*Attorney, Agent, or Firm*—James R. Hoatson, Jr.; Raymond H. Nelson; William H. Page, II

[57] ABSTRACT

Metal-ceramic composites may be prepared by treating the ceramic component of the composite with a second metal prior to subjecting the metal-ceramic composite to a sintering operation. By pretreating the ceramic component of the composite, it is possible to obtain a composite which will undergo sintering at an elevated temperature to form a composite which will possess desirable characteristics such as increased density, hardness and low thermal coefficient of expansion, thus enabling the composites to be utilized in a wide variety of applications.

13 Claims, No Drawings

DENSIFICATION OF METAL-CERAMIC COMPOSITES

BACKGROUND OF THE INVENTION

Metal-ceramic composites may find a wide variety of uses where certain physical characteristics play an important role in their use. For example, in many instances it is desirable that the article which is employed for particular purposes possess a low thermal coefficient of expansion. In addition to this desirable characteristic, it is also important that materials which may be used as valve seats, pumps, let-down valves, fluid bed units, lock hoppers, etc. also possess a high degree of strength as well as resistance to wear in order to combat or overcome the problems which arise in areas concerned with various deleterious effects such as wear or erosion.

In many instances where the metal articles possess relatively complex or convoluted shapes, it has been necessary to cast the material in a rough form, following which the desired final configuration with attendant tolerances is attained by machining the article. However, with the advent of powder metallurgy followed by a subsequent sintering operation, the obtention of the desired articles with the final shape can be obtained with a corresponding economical advantage over conventional casting and machining techniques, a portion of the economical advantage being attributable to the elimination of an extensive machining operation.

In many instances composites of metals and ceramics are relatively porous in nature with a concurrent relatively low density. These characteristics lead to inherent disadvantages in the finished article in that the articles will not possess a high strength which is necessary for any applications in which the article is to be used. It is therefore necessary to subject these composites to a sintering technique. The sintering process involves a partial welding together of powder particles at temperatures below the melting point thereof and may occur in powder metallurgy with or without the presence of a liquid. The combination of heat and/or pressure during this process will result in the obtention of mixtures which will possess a low porosity with a concurrent densification to produce greater strength, conductivity and, as hereinbefore set forth, density.

Normally speaking, iron powder and silicon carbide powder when in admixture and porous possess a relatively low density and will not sinter readily to form a composite which possesses a high density. This is also true in other metal powder-ceramic composites such as aluminum-silicon carbide, magnesium-silicon carbide, etc. In order to obtain composite articles which are relatively nonporous and possess a high density as well as eliminating the problem of segregation of the ceramic particles to provide a better control of homogeneous distribution of the particles and a metallic microstructure, it is necessary to provide some process for enhancing the sintering of the composite to produce a composite which will not crumble when subjected to strain or pressure but will retain its desired form or configuration, will not be subject to wear or erosion and thus will provide a useable article of manufacture.

BRIEF SUMMARY OF THE INVENTION

This invention relates to a method for preparing a metal-ceramic composite which possesses desirable characteristics such as resistance to wear, low porosity, low thermal expansion, etc. More particularly, the invention is concerned with a method for enhancing the densification of a metal-ceramic composite which will enable the composite to effectively undergo a sintering process to provide the composite with desirable physical characteristics.

As hereinbefore set forth, metal-ceramic composites which may be used in a variety of ways as articles of manufacture must possess desirable physical characteristics. In order to attain these physical characteristics, it is necessary to treat a metal-ceramic composite in various processes or steps, among which is a sintering operation, in order to provide the aforementioned characteristics. However, in many instances where various metals are combined with ceramics such as silicon carbide the sintering of the composite does not produce the desired result. It is therefore necessary to provide a prior step which will enable the sintering operation to be performed in an effective manner.

It is therefore an object of this invention to provide a method for enhancing the densification of a metal-ceramic composite by treating the ceramic component of the composite prior to subjecting the composite to a sintering operation.

In one aspect an embodiment of this invention resides in a method for enhancing the densification of a first metal-ceramic composite which comprises treating the ceramic component of said composite with a second metal, comparible in nature with said first metal, which will react with said ceramic component to form a liquid at sintering temperatures, thereafter subjecting the first metal component and said second metal-treated ceramic component to a sintering process, and recovering the resultant densified first metal-ceramic composite.

A specific embodiment of this invention is found in a method for enhancing the densification of a metal-ceramic composite which comprises treating a ceramic component such as silicon carbide with nickel to form a liquid at sintering temperatures and thereafter subjecting iron and the nickel-treated silicon carbide to a sintering process at a temperature in the range of from about 1000° to about 1200° and recovering the resultant densified iron-silicon carbide composite.

Other objects and embodiments will be found in the following further detailed description of the present invention.

DETAILED DESCRIPTION OF THE INVENTION

As hereinbefore set forth, the present invention is concerned with a process for the densification of metal-ceramic composites whereby a finished composite will possess desirable characteristics such as a low thermal coefficient of expansion, a high tensile strength, as well as a high resistance to wear. In order to obtain these characteristics, it is necessary to subject the composite which is obtained by admixing the metal and the ceramic to a sintering operation whereby the admixtures which are normally porous and possess a relatively low density will undergo a densification to increase the density and restrict the porosity of the mixture. Heretofore, many metal-ceramic composites would not sinter to a high density at temperatures below about 1200° C. When utilizing temperatures greater than 1200° C., the eutectic mixture of the components of the composite which are formed will be in a liquid form and upon solidification, the components will not be homogeneous. As an example of this, when sintering a composite or iron and silicon carbide at 1200° C., a pressed disc melted into a puddle and left behind a carbonaceous skeleton which crumbled when handled. In view of this, it is necessary to obtain a metal-ceramic system which possesses a low melting eutectic with the resultant advantage that the formation of the eutectic liquid could act as a liquid sintering aid. This liquid could act as a rapid diffusion mechanism for the densification of the composite and thus result in the formation of a composite which would meet the desired requirements.

It has now been discovered that when a ceramic such as silicon carbide which makes up one component of a metal-ceramic composite is pretreated with a metal prior to admixture with the metal component of the desired composite, it is possible to obtain a metal-ceramic composite which possesses all of the desirable physical characteristics hereinbefore enumerated. For purposes of this invention, the metal component of the metal-ceramic composite will be designated as the "first metal," while the metal which is utilized to pretreat the ceramic component of the composite will be referred to as the "second metal." These definitions will be used in the specification and the claims appended thereto.

The treatment of the ceramic component of the composite may be effected in any suitable manner necessary to deposit a layer of the second metal on the ceramic particles. For example, one type of treatment which may be employed will comprise an auto-catalytic plating treatment. In addition to this type of treatment, it is also contemplated that the ceramic particles may be coated with the second metal by using a vapor deposition process, electrolytic plating, radio frequency sputtering, plasma sputtering, etc. In the preferred embodiment of the invention, the pretreatment will comprise the auto-catalytic or electroless plating technique due to its natural advantages such as its ease of treatment, excellent contact of the ceramic particles and ease of regulating the amount of second metal plated on the powders by modifying the operating parameters including time, temperature and the concentration of the plating bath. By controlling the concentration of the plating bath, it is possible, as hereinbefore set forth, to control the weight ratio of the second metal to the ceramic, said weight ratio ranging from about 2:1 to about 1:10 of second metal to ceramic being used, the preferred weight ratio being that which contains an excess of the ceramic component of the composite. The type of second metal which is employed to plate the ceramic such as silicon carbide will depend upon the phase diagrams for the second metal and the ceramic. Examples of second metals which may be used to plate the ceramic component will include nickel, manganese, germanium, aluminum, magnesium, cooper, calcium, barium, etc. The second metal which is used for the treatment of the ceramic will be compatible in nature with the first metal component of the composite. The term "compatible" as used in the specification and appended claims will be defined as the ability of the second metal to wet or to form an alloy or intermetallic with the first metal. Some examples of compatibility which may be used to illustrate the concept is the use of such second metals as barium, calcium, copper or magnesium to treat the ceramic when the first metal is aluminum, the use of barium, calcium, germanium or magnesium to treat the ceramic when copper is the first metal or the use of aluminum, nickel or manganese to treat the ceramic when iron is the first metal. It is to be understood that these examples are only for purposes of illustration and that the invention is not necessarily limited thereto.

In the preferred embodiment of the invention when utilizing silicon carbide as the ceramic component of the composite, nickel is the second element most widely used due to the eutectic melting temperatures of nickel and silicon as well as the controlled method of deposition of the nickel on the silicon carbide particles when utilizing an auto-catalytic plating process.

As an illustration of one method of treating the ceramic with the second metal, a plating bath comprising a compound such as nickel hypophosphite is heated to a temperature of about 85° C. and thoroughly agitated. The ceramic material such as silicon carbide in powder form is then placed in the bath for a period of time which may range from about 10 minutes to about 1 hour or more in duration, the treatment time being dependent upon the activity of the bath and the amount of second metal which is to be deposited on the surface of the ceramic. The bath is then maintained at a temperature in the range of from about 80° to about 90° C. with constant agitation to ensure complete reaction for the aforesaid period of time. Upon completion of the residence time, agitation and heating are discontinued and the second metal treated ceramic is allowed to settle. Upon completion of the settling time, the treated ceramic is separated from the plating bath by conventional means such as filtration, decantation, etc. and thoroughly washed with deionized water in multiple stages to ensure complete recovery of the plating material. After multiple washings, the metal treated ceramic is then dried in a drying oven at a temperature of about 110° C. for a period of time sufficient to remove all moisture therefrom. It is contemplated within the scope of this invention that auto-catalytic plating solutions such as nickel salts, copper salts, aminoborane, nickel borohydride, etc. may also be employed to treat the ceramic material to provide the desired material which is thereafter admixed with the first metal to form the desired metal-ceramic composite.

The metal-ceramic composite which is to undergo densification is then prepared by thoroughly admixing the first metal such as aluminum, copper, iron, magnesium, etc. and the treated ceramic powders by mechanical means to ensure a thorough admixing of the two components of the composite. For example, one type of mixing which may be utilized comprises a dry or wet shaking process in which the two components are thoroughly agitated in a mechanical shaker or by the utilization of appurtenances such as paddles, stirrers, whisks, beaters, etc., said admixing being effected at ambient temperatures and pressures.

The mixed compositions may then be pressed in desired dies, the pressing being effected at ambient temperature under pressures ranging from about 15,000 to about 80,000 pounds per square inch (psi). Following this, the articles are then subjected to a sintering operation in which the articles are sintered at a temperature in the range of from about 1000° C. to about 1200° C., preferably in a nitrogen atmosphere for a period of time which may range from about 1 to about 4 hours or more in duration. Upon completion of the desired residence time, the articles are removed from the formation in which the sintering was effected, allowed to cool to room temperature, and recovered for the desired use.

The following examples are given for purposes of illustrating a process for preparing metal ceramic composites which, when subjected to a sintering operation, will remain intact, possessing an increased density and low thermal coefficient of expansion. However, it is to be understood that these examples are merely illustrative in nature and that the present process is not necessarily limited thereto.

EXAMPLE I

In this example, a silicon carbide powder was pretreated by heating a commercial two-part solution sold under the trade name Nickelmerse SPL by Lea Ronal Corporation, the solution having a nickel hypophosphite base. The solution was prepared by admixing 15 parts of Part A, 10 parts of Part B and 75 parts of deionized water by volume and heating to a temperature of about 85° C. with continuous agitation. Silicon carbide powder (2 to 15 microns in size) in an amount of 4 grams was placed in 200 cc of the bath solution and maintained in the bath for a period of 30 minutes at 88° C. with continuous agitation. At the end of this period, heating was discontinued as was the stirring and the nickel treated silicon carbide powder was allowed to settle. The solution was decanted and the powder was washed three times with cold deionized water. The washed powder was then dried in a drying oven at a temperature of 110° C. and after drying was sieved through a #200 sieve. Energy dispersion X-ray (EDAX) analysis disclosed that there was a 2:1 weight ratio of silicon to nickel.

EXAMPLE II

In this example, silicon carbide powder similar in nature to that utilized in Example I above, which was from 2 to 15 microns in size, was placed in a solution similar to that used in Example I above. A solution was maintained at a temperature of 82° C. for a period of 30 minutes with continuous agitation. At the end of the plating period, the nickel treated silicon carbide powder was separated from the plating solution by decantation, washed three times with cold deionized water, dried and recovered. EDAX analysis showed a weight ratio of 3:1 silicon to nickel.

Another sample of silicon carbide powder was treated in a similar manner by placing 5 grams of powder in 180 cc of a plating solution similar to that set forth in Example I above. The solution was maintained at a temperature of 91° C. for a period of 15 minutes with constant agitation. At the end of this period, agitation and heating were discontinued and, after the powder had settled, the plating solution was removed by decantation. The nickel plated silicon carbide powder was washed three times with deionized water, dried, and recovered. EDAX analysis of this sample disclosed a weight ratio of 6.5:1 silicon to nickel.

EXAMPLE III

Samples of metal-ceramic composites were prepared by weighing out 0.5 gram of the nickel treated silicon carbide powders prepared according to Examples I and II above with 5.5 grams of iron. In addition, another sample was also prepared by admixing 0.5 gram of untreated silicon carbide powder with 5.5 grams of iron. The two components of each composite were mixed by vigorous shaking in a glass jar for a period of 5 minutes, following which the mixed compositions were then pressed into 1" diameter discs. The pressing of the disks was effected at room temperature in steel dies in a hydraulic pill press under a pressing pressure of 75,000 psi for a period of 1 minute. The dimensions of the pressed disks with respect to diameter and height were measured with a micrometer, the green density being calculated from those measurements and the pressed weight.

Following this, the samples were sintered in a tube furnace using a 3" inner diameter alumina furnace tube. The samples were carried into the tube in alumina boats in the furnace. All of the samples were sintered under an atmosphere comprising a nitrogen/2% hydrogen mixture which flowed through the tube continuously from cold start to cold finish. The sintering was effected by raising the temperature of the furance to the desired range, that is, from 1000° to 1200° C, over a period of 3 hours, the temperature being maintained at the sintering temperature for periods of time ranging from 2 to 2.5 hours. At the end of the desired sintering time, heating was discontinued and the furnace was allowed to return to room temperature. After completion of the sintering operation, the densities of the specimens were claculated from dimensional and weight measurements and, in addition, the percentages of open porosity by volume of certain representative samples were calculated by liquid displacement and absorption techniques. (Archimedes method).

In Table I below, the results are given for three samples comprising an iron-silicon carbide composite containing 20% by volume of silicon carbide which had not been pretreated by the addition of nickel. Sample A was pressed into disc form at 50,000 psi and sintered at 1200° C. for a period of two hours in a nitrogen atmosphere. Sample B was pressed at 80,000 psi and sintered at a temperature of 1100° C. for a period of two hours in a nitrogen atmosphere and sample C was pressed a 80,000 psi followed by sintering at a temperature of 1160° C. for a period of two hours in a nitrogen atmosphere which contained 2% hydrogen.

TABLE I

| | A | | B | | C | |
|---|---|---|---|---|---|---|
| | As Pressed | Sintered | As Pressed | Sintered | As Pressed | Sintered |
| Dia. (in) | 1.00 | Melted | 1.00 | .995 | 1.00 | .955 |
| Ht. (in) | .202 | | .188 | .183 | .152 | .147 |
| Wt. (g) | 11.96 | | 11.99 | 12.05 | 9.96 | 9.90 |
| Density (g/cc) | 4.57 | | 5.10 | 5.17 | 5.04 | 5.74 |
| % Theor. Density | 66% | | 74% | 75% | 73% | 83% |

In Table 2 below, samples were prepared in which the silicon carbide was pretreated with nickel so that the treated silicon contained varying amounts of nickel. Sample D which contained a weight ratio of 2:1 silicon to nickel was pressed into a disc at a pressure of 75,000 psi and sintered for two hours in a nitrogen atmosphere which contained 2% hydrogen, the disc being sintered at 1000° C. and then being sintered a second time at 1100° C. Sample E which had a weight ratio of 2:1 silicon to nickel was pressed at 75,000 psi and sintered at a temperature of 1100° C. for a period of 2.5 hours under a nitrogen atmosphere which contained 2% hydrogen. Samples F and G both comprised nickel treated silicon carbide in which the weight ratio of silicon to nickel was 3:1 while in samples H and I the nickel treated silicon carbide contained a weight ratio of 6.5:1 silicon to nickel. The four samples (F,G,H,I) were all pressed at 75,000 psi and sintered concurrently at a temperature of 1100° C. for a period of 2.5 hours under a nitrogen atmosphere which contained 2% hydrogen. To contrast samples D through I inclusive, another sample, J, was prepared by pressing an untreated silicon carbide-iron composite at 75,000 psi and sintering the pressed disc under concurrent conditions, that is, 1100° C. for a period of 2.5 hours under a nitrogen atmosphere containing 2% hydrogen. Samples D through J comprised the composite which contained 20% by volume of silicon carbide, the remainder being iron.

TABLE 2

| | D | | | E | | F | | G | |
|---|---|---|---|---|---|---|---|---|---|
| | | Sintered | | | | | | | |
| | As Pressed | 1000° C. | 1100° C. | As Pressed | Sintered | As Pressed | Sintered | As Pressed | Sintered |
| Dia. (in) | 1.00 | .975 | .925 | 1.00 | .931 | 1.00 | .943 | 1.00 | .940 |
| Ht. (in) | .131 | .131 | .124 | .089 | .088 | .134 | .127 | .135 | .127 |
| Wt. (g) | 8.98 | 9.01 | 8.99 | 5.99 | 5.90 | 8.98 | 8.96 | 9.01 | 8.99 |
| Density (g/cc) | 5.28 | 5.62 | 6.58 | 5.19 | 6.01 | 5.16 | 6.16 | 5.13 | 6.22 |
| % Theor. Density | 76% | 81% | 95% | 75% | 87% | 74% | 89% | 74% | 90% |
| % Open Porosity by Liquid Infiltration | | | 0% | | | | 4% | | 6% |

| | H | | I | | J | |
|---|---|---|---|---|---|---|
| | As Pressed | Sintered | As Pressed | Sintered | As Pressed | Sintered |
| Dia. (in) | 1.00 | .946 | 1.00 | .950 | 1.00 | 1.02 |
| Ht. (in) | .135 | .128 | .134 | .127 | .136 | .144 |
| Wt. (g) | 9.01 | 8.97 | 8.93 | 8.87 | 8.99 | 9.02 |
| Density (g/cc) | 5.13 | 6.08 | 6.08 | 5.13 | 5.09 | 4.68 |
| % Theor. Density | 74% | 88% | 74% | 87% | 73% | 60% |
| % Open Porosity by Liquid Infiltration | | 5% | | 6% | | 21% |

It is noted from a comparison of samples A, B, C in Table I and sample J in Table 2 that when compared to samples D through I, the theoretical density of the sintered samples increased dramatically over the theoretical density of the as pressed samples as well as a relatively low open porosity. This is in contrast to the theoretical densities of the samples prepared from untreated silicon carbide, the theoretical density decreasing in one instance and increasing only slightly in other samples.

EXAMPLE IV

In this example, tests were performed to determine the thermal coefficient of expansion of various samples prepared according to the method set forth in the above examples. The thermal coefficient of expansion tests were performed by cutting samples to a size of approximately 1.00"×0.100"×0.150" and tests were performed in the direction which was perpendicular to the cold-pressing direction. Expansion measurements were taken in a range of from 20° to 300° C. at a heating rate of 5° C. per minute. Although the tests were performed in a nitrogen flow in the furnace, it is not critical to utilize a neutral atmosphere. Both heating cycles and cooling cycles were controlled within a desired cooling rate. The temperature and length measurements were recorded after the specimen had reached the limited equilibrium temperature which was determined by stable temperature and length ratings over a 15 minute period. The length measurements on the dilatometer were calibrated by measuring the millivolt output of the displacement sensor against 25 mils of displacement measured by a micrometer, the 25 mils of calibrated displacement being approximately 10 times larger than the 3 mil thermal expansion which is normally observed in testing. The results of these tests are set forth in Table 3 below.

TABLE 3

| | | Thermal Coefficient of Expansion ppm/°C.) | |
|---|---|---|---|
| Sample | Test # | Up (Range-°C.) | Down (Range-°C.) |
| D | 1 | 11.4 ppm/°C. (20°-300° C.) | 12.0 ppm/°C. (300°-130° C.) |
| | 2 | 11.9 ppm/°C. (51°-300° C.) | 11.6 ppm/°C. (300°-70° C.) |
| F | 1 | 12.8 ppm/°C. (25°-294° C.) | 11.6 ppm/°C. (294°-33° C.) |
| | 2 | 12.5 ppm/°C. (20°-302° C.) | 12.4 ppm/°C. (302°-98° C.) |
| | 3 | 12.7 ppm/°C. (92°-295° C.) | 12.8 ppm/°C. (295°-75° C.) |
| | 4 | 12.3 ppm/°C. (102°-302° C.) | 12.1 ppm/°C. (302°-100° C.) |
| H | 1 | 12.3 ppm/°C. (59°-300° C.) | 12.5 ppm/°C. (300°-110° C.) |
| | 2 | 12.1 ppm/°C. (97°-303° C.) | 12.6 ppm/°C. (303°-105° C.) |

EXAMPLE V

Another test which was performed to illustrate the desirable physical characteristics of the metal-ceramic composites of the present invention which had been pretreated with a second metal prior to compositing the samples comprises a hardness test. The test was performed with a Rockwell hardness tester on the B-scale (1/16" ball—100 kg load). The results of this test are set forth in Table 4 below:

TABLE 4

| Sample | Hardness Values |
|---|---|
| J | 26, 27, 27 |
| D | 87, 88, 90 |
| F | 86, 88, 86 |
| G | 83, 83, 84 |
| H | 83, 86, 86 |
| I | 83, 84, 84 |

It is therefore readily apparent from the above Table that the samples D, F, G, H and I which comprised an iron-silicon carbide composite in which the silicon carbide had been pretreated with nickel prior to admixture with the iron exhibited a greater degree of hardness than did sample J which comprised only an iron-silicon carbide composite which had not been pretreated prior to admixture.

I claim as my invention:

1. A method for enhancing the densification of a first metal-ceramic composite which comprises treating the ceramic component of said composite with a second metal compatible in nature with said first metal, which will react with said ceramic component to form a liquid at sintering temperatures, thereafter subjecting the first metal component and said second metal-treated ceramic component to a sintering process, and recovering the resultant densified first metal-ceramic composite.

2. The method of claim 1 in which said sintering temperatures are in a range of from about 1000° to about 1200° C.

3. The method claim 1 in which said second metal and ceramic component are present in said liquid in a weight percent ratio of from about 2:1 to about 1:10 percent metal per percent ceramic component.

4. The method of claim 1 in which said ceramic component comprises silicon carbide.

5. The method of claim 1 in which said first metal component comprises iron.

6. The method of claim 1 in which said first metal component comprises copper.

7. The method of claim 1 in which said first metal component comprises magnesium.

8. The method of claim 1 in which said first metal component comprises aluminum.

9. The method of claim 1 in which said second metal comprises nickel.

10. The method of claim 1 in which said second metal comprises manganese.

11. The method of claim 1 in which said second metal comprises magnesium.

12. The method of claim 1 in which said second metal comprises copper.

13. The method of claim 1 in which said second metal comprises germanium.

* * * * *